United States Patent [19]

Chen et al.

[11] 4,004,805

[45] Jan. 25, 1977

[54] ELECTRONIC LINE MONITORING SYSTEM FOR A TENNIS COURT

[76] Inventors: Kun-Mu Chen, 4608 Tacoma Blvd., Okemos, Mich. 48864; Bertha L. Chen, 7200 Marine Drive, Alexandria, Va. 22307

[22] Filed: Aug. 30, 1974

[21] Appl. No.: 499,341

[52] U.S. Cl. ..... 273/29 R; 340/323 R; 250/221

[51] Int. Cl.[2] ..... A63B 61/00

[58] Field of Search ..... 273/31, 29 R; 340/258 B, 421, 323; 250/221, 222, 215

[56] References Cited

UNITED STATES PATENTS

| | | | |
|---|---|---|---|
| 2,099,868 | 11/1937 | Sing et al. | 340/258 B |
| 3,335,285 | 8/1967 | Gally, Jr. et al. | 340/258 B |
| 3,415,517 | 12/1968 | Krist | 273/31 |
| 3,623,057 | 11/1971 | Hedin | 340/258 B |
| 3,688,298 | 8/1972 | Miller et al. | 340/258 B |
| 3,711,846 | 1/1973 | Schlisser | 250/221 UX |
| 3,792,260 | 2/1974 | Stewart et al. | 250/215 |
| 3,810,148 | 5/1974 | Karsten | 340/323 |

*Primary Examiner*—Richard C. Pinkham
*Assistant Examiner*—T. Brown

[57] ABSTRACT

An optical tennis line sensing system employs a double beam laser for projecting only a pair of collimated beams of light along the entire outer boundary and base lines of a tennis court with one beam positioned on the line slightly above the playing surface and the remaining being positioned slightly outside the lines. A detector circuit including photo multiplier light sensors detects interruptions of the light beam in a timed sequence for generating a signal indicating when a tennis ball is out of bounds. The detector circuit discriminates between momentary interruption of one of the light beams by a tennis ball and interruption of one or both of the light beams by the player's foot. Display means coupled to the detector circuit displays only out-of-bounds shots which are marginal and which cannot be accurately called by the line judges. A laser beam and photomultiplier and associated detection and display circuit are also employed at the service lines and along the top of the net to detect fault and let services respectively.

18 Claims, 6 Drawing Figures

ELECTRONIC LINE MONITORING SYSTEM FOR A TENNIS COURT

BACKGROUND OF THE INVENTION

The present invention relates to an optical detection system for a tennis court to display out-of-bounds shots and fault and let services of a tennis ball.

As even the most inexperienced tennis novice can attest, many tennis shots fall in marginal areas where it is difficult for the players or line judges to determine with any accuracy the position of the tennis ball as it strikes the playing surface. As a result, during the course of a game, several erroneous decisions can be made. In today's present surge of professional tennis with relatively high monetary awards at stake, there exists a need for more accurate judging of the game.

Several proposals have been made to automatically detect tennis balls near the line. These include the embedding of pressure-sensitive devices along the lines of the tennis court to detect the impact of the tennis ball as well as a recent proposal whereby an electromagnetic radiation system including transmission lines embedded in the court have been attempted. The latter proposal is the subject of U.S. Pat. No. 3,774,194, issued on Nov. 11, 1973 to P. Jokay et al.

While these systems represent an improvement over the present judging system, they rely either on impact caused by the tennis ball with the playing surface or on specially modified tennis balls which interact with the electromagnetic field around the court. As a result, the installation requires the embedding of wires in the tennis court and is of a permanent nature requiring installation when the tennis court is initially constructed or relatively expensive modification to existing courts. Such systems, once installed, therefore, cannot be employed in other courts and should they require repair, it may be necessary to tear up the boundary lines of the court to obtain access to a broken wire or other buried component.

If a simple single beam optical detector were employed with a beam tracing the boundaries, the beam could be interrupted by either a tennis ball or one of the players' feet. Thus, such a system would not be reliable in detecting out-of-bounds shots.

There exists, therefore, a need for a system which provides the desired accuracy to at least assist the judges in making close calls and one which is relatively simple and thus, inexpensive to manufacture and maintain. Preferably, this system should be portable such that it can be employed at different locations and be easily repaired.

SUMMARY OF THE INVENTION

The system of the present invention satisfies this need by tracing the boundary lines of the tennis court with a pair of beams of light spaced slightly above the playing surface such that a tennis ball will interrupt the outer light beam when out of bounds. Single beams of light can be employed for detecting the service line and net lines. Optical detectors normally receive continuous light beams which are interrupted momentarily by the tennis balls when out of bounds or the like and are interrupted in a different manner during normal play by the players' feet such that a detector circuit coupled to the light detectors can discriminate between such interruptions and provide a judgment signal only when the beams are interrupted by a tennis ball.

The present invention and its features and advantages can best be understood by referring to the following description thereof together with the accompanying drawings in which:

DETAILED DESCRIPTION OF THE PREFERRED EMBODIMENT

Figure 1:
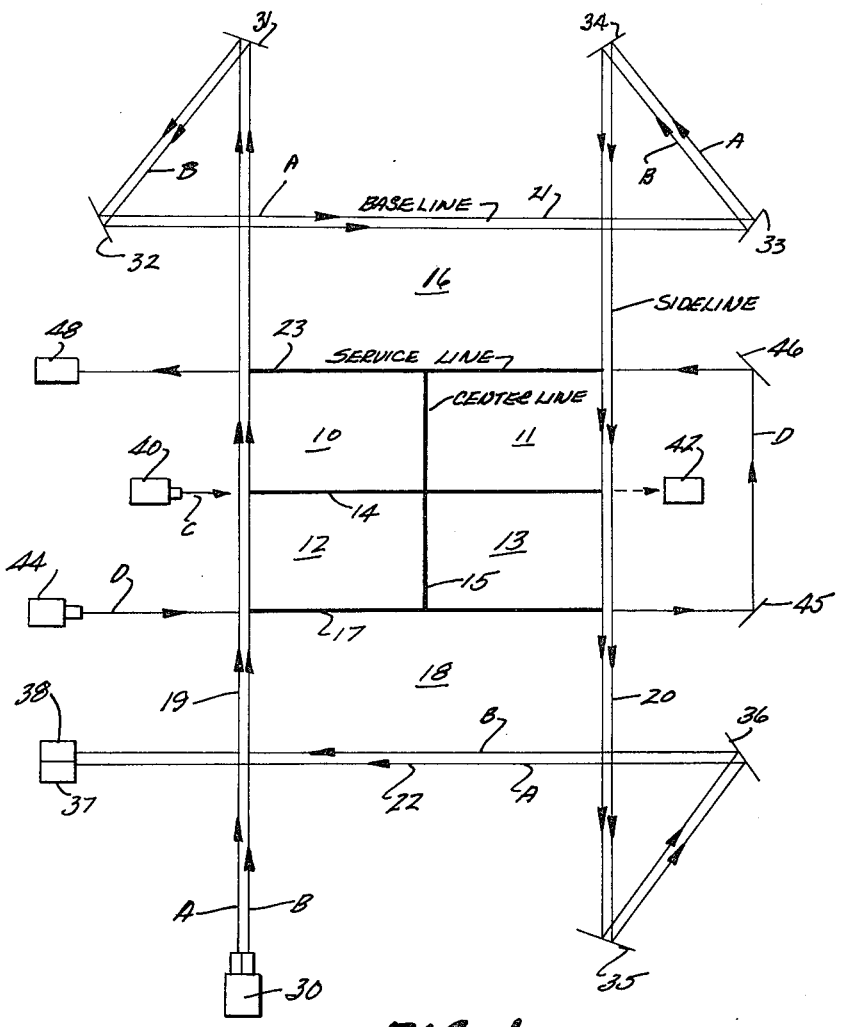
FIG. 1 is a plan, schematic view of a tennis court including a line sensing system embodying the present invention.
Figure 2:
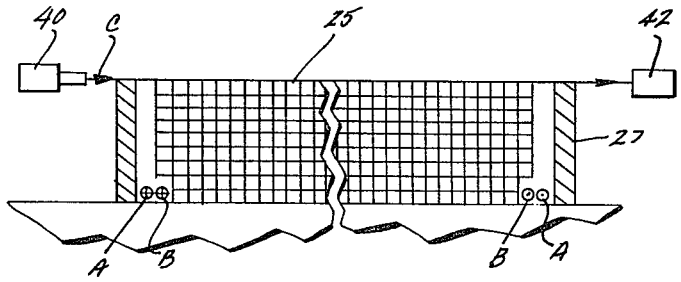
FIG. 2 is a front view of the tennis court shown in FIG. 1.

Referring now to the drawings and initially to FIGS. 1 and 2, there is illustrated a tennis court which includes four service courts 10, 11, 12 and 13, separated by the net line 14 and center line 15 and bounded by side lines 19 and 20 and service lines 17 and 23. The court also includes back courts 16 and 18 bounded on the net side by the service lines, by side lines 19 and 20 on the sides, and by the base lines 21 and 22 on the remaining border. The net 25 extends along the net line 14 and is supported by posts 26 and 27 in a conventional manner to span the width of the tennis court.

The side line and base line boundaries of the court are traced by a pair of laser beams represented by the lines identified as A and B in the figure. Beams A and B are transmitted by a dual beam helium neon laser projector 30 to travel along the boundaries of the court in a direction indicated by the arrowheads accompanying the light beams. The beams are spaced approximately 2 inches apart and approximately an inch or less above the playing surface. Beam A traces the outer edge of the boundary line while beam B is positioned inside of the boundaries.

The beams are generated by a conventional dual beam laser 30 positioned at the left front corner of the court as seen in FIG. 1. Beams A and B exit projector 30 to first trace the left side line 19 impinging upon a first reflector 31 set at approximately 45° to the side line and thence to a second reflector 32 directing the reflected beams along the rear base line 21. Reflectors 31 and 32 (and the remaining reflectors) can be conventional mirrors approximately 1 foot square or smaller and mounted in a suitable conventional stand permitting adjustment of the light beams along the lines of the court.

Beams A and B then trace the rear base line 21 and intercept a third reflector 33 set at an approximately 45° angle to the base line and thence to a fourth reflector 34 to then trace the right side line 20. The beams then intercept a fifth reflector 35 positioned in the front right corner of the court at roughly a 45° angle to the right side line 20 to direct the beams to a sixth reflector 36 for subsequently directing the beam along the front base line 22. A pair of optical detectors 37 and 38 are positioned in alignment with the front base line to intercept the light beams which have thus traced the entire peripheral boundary of the tennis court.

The reflectors 31–36 are positioned from 10 to 15 feet away from the corners of the tennis court so as not to interfere with the normal play. The laser generator 30 and optical detectors 37 and 38 likewise are positioned sufficiently away from the court so as not to interfere with the players during the course of the tennis match. The mirrors may be mounted in adjustable stands to facilitate adjustment of the beams when the sensing system is initially set up on a court. The projector 30, reflectors and the light detectors all are portable and can be battery powered such that the system can be used with different locations. Of course, the system can be permanently installed if desired.

The system further includes a net line laser generator 40 which directs a beam of light C across the top edge of net 25 to impinge upon an optical detector 42. Beam C projects across the top edge of the net such that if a tennis ball touches the net in the least, the light beam will be interrupted by the ball and the detector 42 will respond thereto indicating a let service.

In addition, the installation may include a service line sensing system including a single beam laser generator 44 projecting a beam of light D which traces the front service line 17 and impinges upon a first reflector 45 set at a 45° angle to the service line 17 to direct light to a second reflector 46 which in turn directs the beam D across the rear service line 23 and thence upon an optical detector 48. This beam is spaced approximately 1 inch above the surface of the court and traces the boundaries of the service lines to detect a tennis ball which interrupts the light beam indicating a fault service during serving.

It may be necessary in some installations to provide a rectangular cutaway of a portion of the net, as seen in FIG. 2, to permit the beams to travel through the net along the sidelines in a nonobstructed manner such that the light beams will normally continuously impinge upon detectors 37 and 38 and be interrupted only by the presence of a tennis ball or a player's foot.

It is noted here that although the preferred embodiment employs a laser beam for providing a coherent, collimated beam of light, other light sources of either visible or nonvisible spectra can be employed so long as the beam can be collimated to a size which will permit tracing of the boundaries of the tennis court and detection of a tennis ball. The responsive frequency of the detectors must, of course, be selected to be capable of detecting the beam of radiation directed along the various boundaries of the tennis court by the projectors and reflectors. Having described the physical layout of the beam projection system employed in the tennis line sensing system of the present invention, a description of the detecting system for discriminating between interruption of the beam or beams by a tennis ball and by the player's feet will now be presented in reference to FIGS. 3 and 4.

Figure 3:
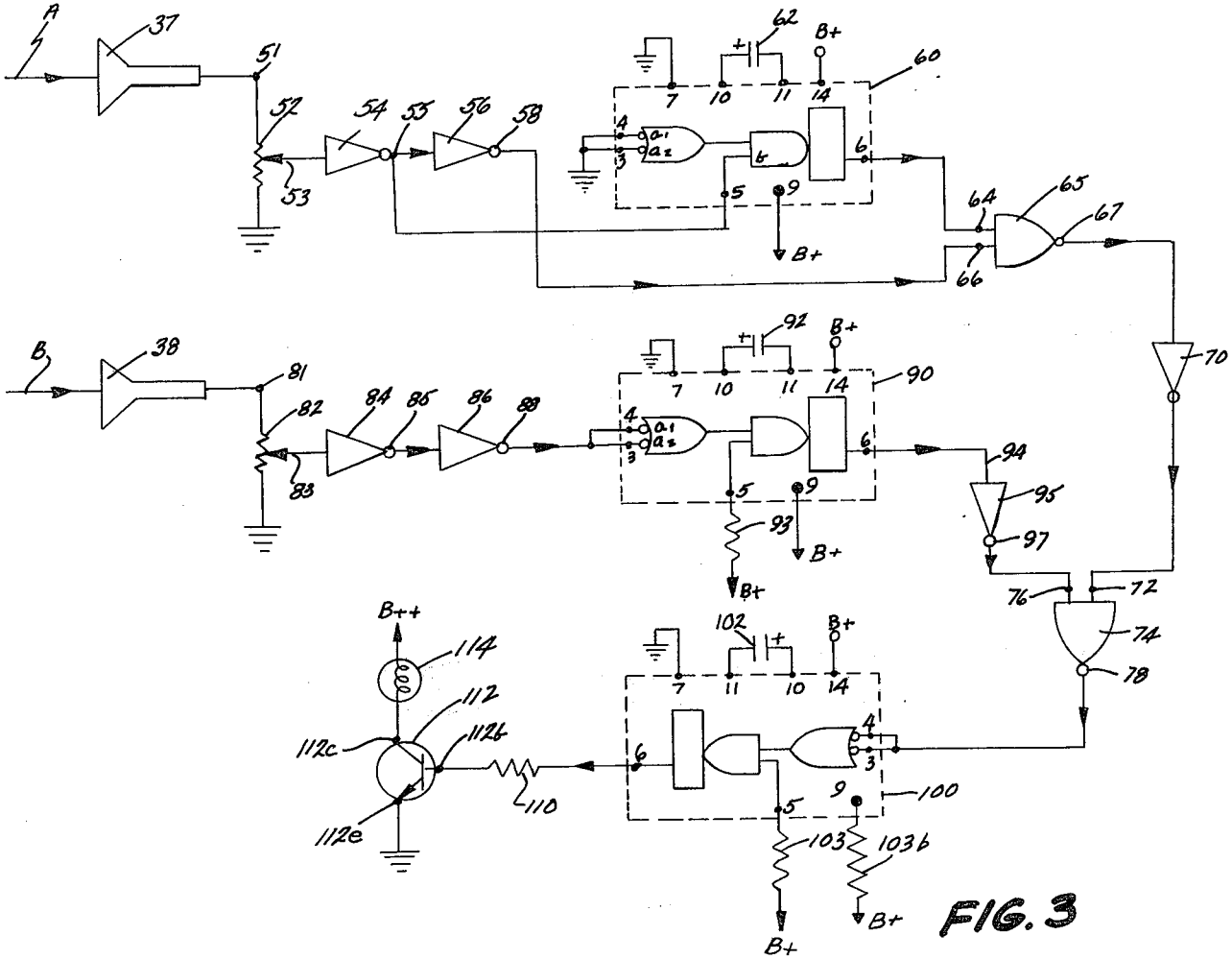
FIG. 3 is an electrical circuit diagram in schematic form of the detector circuit used in the present invention.

Initially, it is noted that due to the approximate 2 inch spacing between beams A and B, a tennis ball will not normally simultaneously interrupt these beams. Instead, one or the other of the beams will be interrupted momentarily and for a duration significantly less than the interruption caused by the player's foot crossing one of the lines due to the higher velocity of the ball. Additionally, the players' feet normally will interrupt a beam not only for a longer period of time, but also will typically interrupt both beams if the player's foot crosses the outer beam marking the boundary. With these given sets of circumstances, the detector circuit's logic responds to interruptions of the light beam to provide an indication of an out-of-bounds tennis ball, fault service, or let service and close call situations only when the beam or interruption is actually caused by tennis ball. Line judges are used to call obvious shots. The circuitry employed in connection with the beams A and B and the detectors 37 and 38 associated therewith is shown in FIG. 3.

Detector 37 intercepts light beam A at the end of its travel and generates an electrical signal in response thereto which is applied across a potentiometer 52 coupled between output terminal 51 of the detector circuit and ground. Circuit 37 comprises, in the preferred embodiment, a commercially available photomultiplier which normally provides a positive output signal which, when the light beam A is interrupted, decreases toward zero as a function of the character of the beam interruption. The output signal is illustrated by waveform 50 in FIG. 4, which appears at output terminal 51. The wiper arm 53 of potentiometer 52 is coupled to an inverter amplifier 54 having its output terminal 55 coupled to the input of a second inverter amplifier 56 and further coupled to input terminal 5 of a monostable multivibrator 60. Multivibrator 60 is a commercially available integrated circuit type SN74121N with the commercially designated pin numbers shown within the phantom lines representing the multivibrator. The signal at terminal 55 is represented by waveform 57 in FIG. 4. Capacitor 62 coupled between terminals 10 and 11 together with the coupling of terminal 9 of the multivibrator to a source of operating potential B+ provide the desired time constant for the multivibrator and in the preferred embodiment, was a 50 $\mu$F capacitor. Preferably, this capacitor is variable to that the time constant can be adjustable.

Input terminals 3 and 4 of multivibrator 60 are grounded as is the ground terminal 7 while power input terminal 14 is coupled to a source of operating potential indicated as B+ in the diagram. Output terminal 6 of the multivibrator 60 is coupled to input terminal 64 of a first NAND gate 65. The signal at terminal 64 is indicated by waveform 61 of FIG. 4. The remaining input terminal 66 of the NAND gate is coupled to the output terminal 58 of inverter 56. The signal at terminal 58 is indicated by waveform 59 of FIG. 4. The output terminal 67 of NAND gate 65 is coupled to an inverter amplifier 70 having its output terminal coupled to an input terminal 72 of a second NAND gate 74. The signals at terminals 67 and 72 are represented by waveforms 68 and 71, respectively, of FIG. 4.

Detector 38 intercepts light beam B at the end of its travel and generates an electrical signal in response thereto which is applied across a potentiometer 82 coupled between the output terminal 81 of the detector circuit and ground. Circuit 38 comprises, in the preferred embodiment, a commercially available photomultiplier which normally provides a positive output signal which, when the light beam B is interrupted, decreases toward zero as a function of the character of the beam interruption. The output signal is illustrated by waveform 80 in FIG. 4, which appears at output terminal 81. The wiper arm 83 of potentiometer 82 is coupled to an inverter amplifier 84 having its output terminal 85 coupled to the input of a second inverter amplifier 86. Output terminal 88 of inverter 86 is coupled to input terminals 3 and 4 of a second monostable multivibrator 90. Multivibrator 90 is a commercially available integrated circuit type SN74121N with the commercially designated pin numbers shown within the phantom lines representing the multivibrator. The signals at terminals 85 and 88 are represented by waveforms 87 and 89, respectively, in FIG. 4. Capacitor 92 coupled between terminals 10 and 11, together with the coupling of terminal 9 of the multivibrator 90 to a source of operating potential B+, provides the desired time constant for the multivibrator and in the preferred embodiment, was a 75 $\mu$F capacitor. The value of this capacitor can be made variable for easy adjustment of the time constant.

Terminal 7 of multivibrator 90 is grounded while power input terminal 14 is coupled to a source of operating potential indicated as B+ in the diagram. Terminal 5 is also coupled to B+ via a 1 K$\Omega$ resistor 93. Output terminal 6 of the multivibrator 90 is coupled to input terminal 94 of an inverter amplifier 95. The signal at input terminal 94 is represented by waveform 91 in FIG. 4. Amplifier 95 output terminal 97 is coupled to a second input terminal 76 of second NAND gate 74. The signal at terminal 76 is shown by waveform 98 in FIG. 4.

The output terminal 78 of NAND gate 74 is coupled to input terminals 3 and 4 of a third monostable multivibrator 100. The signal at terminal 78 is represented by waveform 101 of FIG. 4. Multivibrator 100 is also an integrated circuit of the same type as multivibrators 60 and 90 and includes a 10$\mu$F capacitor 102 coupled between input terminals 10 and 11. Terminals 5 and 9 of multivibrator 100 are coupled to the B+ supply by means of resistors 103 and 103*b* having values of 1 K$\Omega$ and 39 K$\Omega$ respectively. Terminal 7 is grounded while terminal 14 is coupled to the B+ supply.

Output terminal 6 of the third multivibrator 100 is coupled to a driver amplifier 112 by means of an input resistor 110. The signal at terminal 6 of multivibrator 100 is shown as waveform 105 in FIG. 4. Amplifier 112 comprises an NPN transistor having a base terminal 112*b* coupled to the resistor 110, an emitter terminal 112*e* coupled to ground and a collector terminal 112*c* coupled to a power supply indicated as B++ in the figure by means of signalling device 114. In the preferred embodiment, signalling device 114 was a light for providing a visual indication of a fault service or out-of-bounds shot. In other embodiments, audible or other suitable alarms can be employed in place of the indicator lamp shown in FIG. 3.

Figure 5:
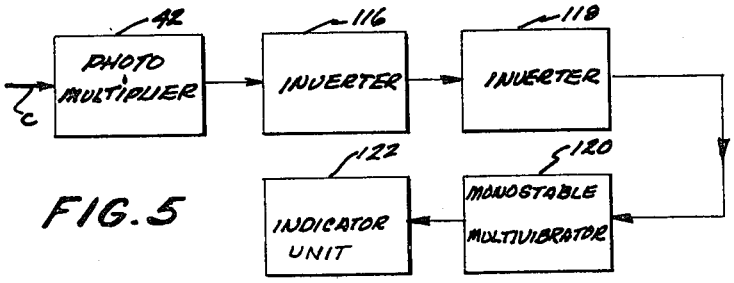
FIG. 5 is a block diagram of the electrical circuit employed with the net line sensor.
Figure 6:
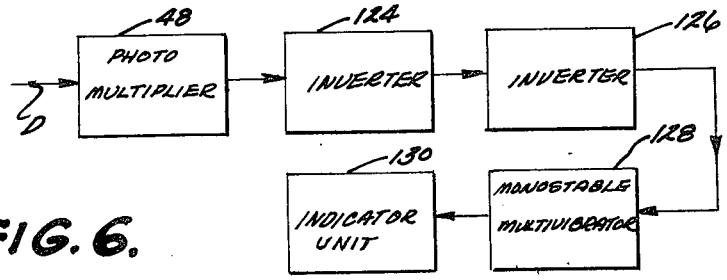
FIG. 6 is a block diagram of the electrical circuit for the service lines sensor.

The net line and service line sensing circuits are shown in FIGS. 5 and 6. In FIG. 5, light beam C is intercepted by photomultiplier 42 having its output coupled to a first inverter 116 and subsequently through a second inverter 118 to the input of a monostable multivibrator 120. The output signal of multivibrator 120 is applied to an indicator unit 122 which may be an indicator light such as shown in FIG. 3 or an audible alarm having a different frequency than one for the boundary sensor circuit. The inverters and monostable multivibrators are of the same construction as the corresponding circuit elements shown in FIG. 3.

In FIG. 6, the service line light beam D is intercepted by photomultiplier 48 having its output coupled through a first inverter 124 and a second inverter 126 to a monostable multivibrator 128. The output of multivibrator 128 is applied to a third indicator unit 130 having either a light frequency or a sound frequency different than the previous indicators to provide a unique detectable alarm. The inverters and monostable multivibrator are the same as those shown in FIG. 5. Having described the construction of the sensing circuit, a description of its operation for various occurrences during a tennis game is now presented with reference to FIGS. 3 and 4.

OPERATION

Figure 4:
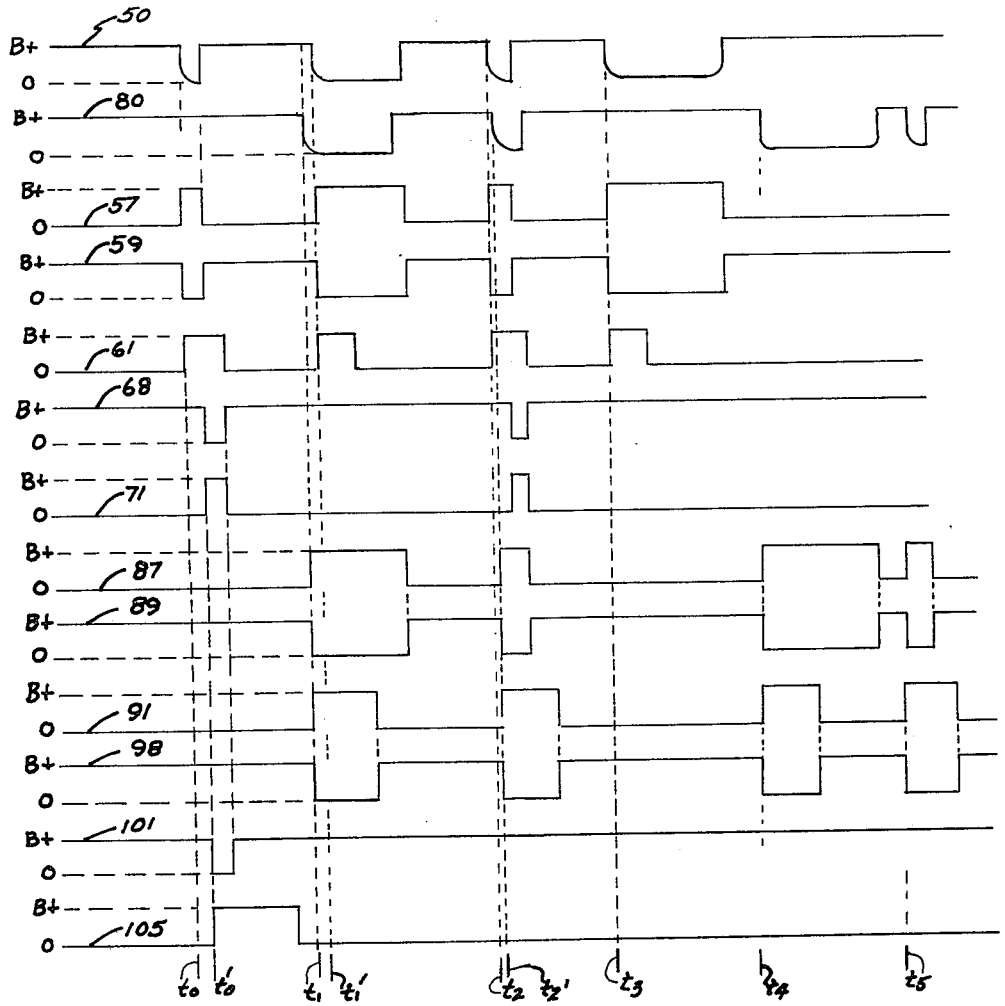
FIG. 4 is a waveform diagram of electrical signals at various locations of the circuit of FIG. 3.

The operation of the system is best understood by considering an example of events as shown in the timing diagram of FIG. 4. At time $t_0$, a tennis ball hits outer beam A. Subsequently, at time $t_1$, both inner and outer beams B and A are interrupted by the player's foot whereby outer beam A is interrupted slightly later at time $t_1'$. Subsequently, both beams are again interrupted by the player's foot only for a shorter period of time at times $t_2$ and $t_2'$. At $t_3$, outer beam A is interrupted by the player's foot and at time $t_4$, inner beam B is interrupted by the player's foot. Finally, inner beam B only is interrupted at time $t_5$ by the tennis ball. As can be seen by examining the alarm signal waveform 105, only when outer beam A is momentarily interrupted by the tennis ball is an indicator output pulse for actuating signalling means 114 generated to cause an out-of-bounds indication by the system. The logic circuit operates to provide this desired result in the following manner.

The negative going output signals 50 (FIG. 4) of photomultiplier 37 caused by interruption of beam A are inverted by amplifier 54, sharpened and again amplified and inverted by amplifier 56. Signal 57, shown in FIG. 4, is applied to the first multivibrator 60 to produce output waveform 61 which is a pulse having a predetermined duration significantly greater than the one to two millisecond duration of interruption of a beam by the tennis ball. This signal is gated by circuit 65 with the output from inverter 56 to provide a negative going pulse shown by waveform 68 which is inverted and applied to gate 74 during the time $t_0'$ after interruption of beam A by the ball and the remaining duration of the pulse from multivibrator 60. Input 76 to gate 74, as seen by waveform 98, will remain at a logic high state since beam B is not interrupted. Thus, as shown in waveform 101, gate 74 develops a negative going pulse at output terminal 78 which is applied to monostable multivibrator 100. Circuit 100 responds to provide an output pulse of sufficient width as shown by waveform 105 to provide an indicator pulse sufficiently wide for indicating that the ball has landed out of bounds somewhere along the boundary of the court.

In the event, however, as occurs at time $t_1$ or time $t_2$, both beams are nearly simultaneously interrupted by the player's feet, both multivibrators 60 and 90 will provide output pulses as seen by waveforms 61 and 91 respectively. The resultant signals applied to gate 74 are shown by waveforms 71 and 98 at terminals 72 and 76 respectively. Since signal 59 from inverter 56 is at a low state, the output of NAND gate 65 remains at a high logic level holding terminal 72 at a logic zero level. Terminal 76 of gate 74 is likewise triggered to a logic low level by the output pulse from multivibrator 90. Thus, gate 74 output will remain at a high level preventing actuation of multivibrator 100 and the development of an alarm pulse when both beams are interrupted nearly simultaneously by the player's feet. It is noted that the time constants of the multivibrators 60 and 90 are selected such that the pulses of waveform 91 are wider than pulses of waveform 61 to accommodate the slight difference in time of interruption of beams A and B by the player's feet and permit concurrent overlapping of the pulses when such an interruption occurs whereupon the inner beam B is typically interrupted first.

At time $t_2$, at which the player's foot interrupts both beams for a relatively short period of time, even though a narrow going pulse is developed by gate 65, input 76 of gate 74 is low and no alarm pulse is generated. Thus, the same result is achieved when both beams are simultaneously interrupted.

At time $t_3$, where the user's foot interrupts the outer beam A only, although multivibrator 60 develops an output pulse 61, gate 65 is not actuated since the beam interruption is longer than the output pulse of multivibrator 60. Thus, terminal 72 of gate 74 remains at a logic low and no indicator pulse is developed. At time $t_4$, when the user's foot interrupts the inner beam only, again terminal 72 of gate 74 remains at a logic low state and the negative going pulse, shown by waveform 98, applied at input terminal 76 does not cause the output of gate 74 to trigger to a logic low state or generate an alarm signal.

Finally, at time $t_5$, when the tennis ball interrupts the inner beam B and, therefore, is an inbounds shot, the momentary interruption of beam B as in the $t_4$ case, does not cause the generation of an indicator pulse since both input terminals of the NAND gate 74 are in a low state and the output terminal remains in the high state.

Thus, by providing gate 74 which develops a negative going output pulse for providing an alarm signal only when both inputs are at a high level, develops in conjunction with gate 65 and the first and second multivibrator circuits (60, 90) a trigger pulse to develop the alarm signal only when a tennis ball interrupts the outer beam indicating an out-of-bounds shot. As noted above, beams A and B are spaced such that it is impossible for the ball to simultaneously interrupt both beams. The biasing of input terminal 72 of gate 74 at a normally low level prevents the development of a trigger signal except when only the outer beam is interrupted and gate 65 provides a negative going signal as shown by waveform 68. This in turn will actuate gate 74 only if input terminal 76 remains high which occurs when beam B is not interrupted.

The line sensor and service line sensing circuits do not require the time discrimination provided by the circuit of FIG. 3 since single beams are employed and the pulses developed by their interruption by a tennis ball will provide the desired alarm signal from the respective multivibrators 120 and 128 (similar to signal 105) for actuating their respective indicators.

It will become apparent to those skilled in the art that various modifications of the present invention can be made. Thus, for example, logic circuits different from the preferred embodiment may be employed to provide the same discrimination between interruption of beams A and B such that an alarm signal is developed only when outer beam A is momentarily interrupted by a tennis ball. Also, as noted above, various indicators can be employed such as audible alarms, flashing lights or the like. The system can be used in other sports when a court is employed as, for example, paddle tennis, volleyball, badminton, etc. Also, the portability of the system permits its adaptation to interchangeable use in these sports as well as use in singles and doubles play. These uses and other modifications to the preferred embodiment will, however, fall within the spirit and scope of the invention as defined by the appended claims.

The embodiments of the invention in which an exclusive property or privilege is claimed are defined as follows:

1. A system for use in conjunction with a tennis court to detect shots in which a tennis ball is slightly out of bounds and provide an indication thereof comprising:

means for establishing a pair of inner and outer substantially parallel reference light beams tracing the entire outer boundary of a tennis court with said outer beam being the out-of-bounds representation point of said boundary when in use, said beams being positioned slightly above the playing surface and spaced from one another a distance such that a tennis ball will not interrupt both beams simultaneously when it strikes the boundary during play; said establishing means being a dual beam light projector and a plurality of light reflectors, at least a pair of said reflectors being positionable near at least three corners of a tennis court to direct said inner and outer beams along the boundary of a tennis court;

means for intercepting said beams after they have traced said boundary and providing signals representative of the interruption of either of said beams;

logic circuit means coupled to said intercepting means for generating a signal only when said outer beam is momentarily interrupted by a tennis ball during play; and signalling means coupled to said logic circuit and responsive to said means generating said signal to provide an alarm indicating an out-of-bounds shot.

2. The system as defined in claim 1 wherein said intercepting means comprises first and second light detectors positioned to receive said light beams after tracing the boundary of a tennis court.

3. The system as defined in claim 2 wherein said logic circuit means comprises an electrical circuit for discriminating between interruption of said light beams by a player's foot and a tennis ball and for providing a signal indicating an out-of-bounds shot when said outer light beam is interrupted by a tennis ball during play.

4. The system as defined in claim 3 wherein said electrical circuit comprises:

a first circuit coupled to said first detector for providing a pulse of a first predetermined duration at an output terminal of said first circuit which is initiated when said outer beam is interrupted;

a first gate circuit having first and second input terminals and an output terminal, said second input terminal being coupled to said output terminal of said first detector and said first input terminal coupled to said first circuit to provide a pulse from said output terminal of said first gate initiated at the end of the an interruption of said outer beam and terminated at the end of said output pulse of said first predetermined duration;

a second circuit coupled to said second detector for providing a pulse of a second predetermined duration at an output terminal of said second circuit which is initiated when said inner beam is interrupted, said second predetermined duration being greater than said first predetermined duration;

a second gate circuit having first and second input terminals, and an output terminal, said first input terminal being coupled to said output terminal of said first gate circuit and said second input terminal coupled to said output terminal of said second circuit to provide a pulse from said at said output terminal of said second gate circuit only when a pulse from said first gate circuit is applied to only said first input terminal of said second gate circuit; and an alarm circuit coupled to said output terminal of said second gate circuit and responsive to signals therefrom to develop an alarm indicating an out-of-bounds shot.

5. The system as defined in claim 4 wherein said signalling means comprises an indicator light.

6. The system as defined in claim 1 and further including:

means for establishing a single reference beam along the service lines of a tennis court above the playing surface;

means for intercepting said single reference beam and providing an electrical signal in response to the interruption of said single reference beam; and circuit means coupled to said intercepting means and responsive to said electrical signal therefrom to provide an alarm when said single reference beam is interrupted.

7. The system as defined in claim 6 and further including:

means for establishing a net reference beam along the net line of a tennis court spaced slightly above the net;

means for intercepting said net reference beam and for providing a net electrical signal in response to the interruption of said net reference beam; and net circuit means coupled to said intercepting means and responsive to said net electrical signal for providing an alarm when said net reference beam is interrupted.

8. A portable boundary line sensing system for a tennis court for detecting out-of-bounds tennis shots comprising:

projector means positionable rear one corner of a tennis court for providing a pair of substantially parallel collimated beams of light spaced slightly above the playing surface and spaced from one another a distance such that a tennis ball will not interrupt both beams simultaneously, said pair of beams defining an inner beam and an outer beam defining the entire boundary line of a tennis court;

reflector means positionable near the remaining corners of a tennis court boundary to reflect said beams from said projector means along the boundary of a tennis court with said outer beam along the out-of-bounds line and the inner beam being spaced therefrom a distance to prevent both said inner and outer beams from being interrupted simultaneously by a tennis ball;

light detector means positionable near said one corner to intercept said beams of light after said beams have traced said boundary of a tennis court and for providing first and second signals when said inner and outer beams of light, respectively, are interrupted; and circuit means coupled to said light detector means and responsive to said first and second signals for discriminating between interruption of said light beams by a player's foot and a tennis ball and for providing an alarm signal indicating an out-of-bounds shot when said outer light beam is interrupted by a tennis ball during play.

9. The system as defined in claim 8 wherein said projector is a laser beam projector.

10. The system as defined in claim 9 wherein said reflector means comprise a plurality of mirrors.

11. The system as defined in claim 8 wherein said light detector means comprise first and second light detectors for intercepting outer and inner beams of light, respectively, said circuit means comprises a first electrical circuit coupled to said first light detector for developing an output pulse only when said outer beam is interrupted for a duration less than a predetermined period of time and a second electrical circuit coupled to said first electrical circuit and to said second light detector for providing a signal only when a pulse is received from said first electrical circuit and said inner beam is not interrupted.

12. The system as defined in claim 11 wherein said circuit means further includes signalling means coupled to said second electrical circuit and responsive to said from said second circuit signal to provide an alarm indicating an out-of-bounds shot.

13. A system for use in conjunction with a tennis court to detect shots in which a tennis ball is slightly out of bounds and provide an indication thereof comprising:

means for establishing a pair of substantially parallel reference beams of light tracing the entire outer boundary of a tennis court said beams defining inner and outer beams with the outer beam defining the out-of-bounds representation of said boundary, said beams positioned slightly above the playing surface and horizontally spaced from one another such that a tennis ball will not interrupt both beams simultaneously when it strikes said boundary during play;

first and second detectors for intercepting said outer and inner beams, respectively, after they have traced said boundary and providing signals representative of the interruption of either of said beams;

a first circuit coupled to said first detector for providing a pulse of a first predetermined duration at an output terminal of said first circuit is and initiated when said outer beam is interrupted.

a first gate circuit having first and second input terminals and an output terminal, said second input terminal being coupled to said first detector and said first input terminal coupled to said output-terminal of said first circuit to provide a pulse from said output terminal of said first gate initiated at the end of the interruption of said outer beam and terminated at the end of said output pulse of said first predetermined duration;

a second circuit coupled to said second detector for providing a pulse of a predetermined duration at an output terminal of said second circuit and initiated when said inner beam is interrupted, said second predetermined duration being greater than said first predetermined duration;

a second gate circuit having first and second input terminals and an output terminal, said first input terminal being coupled to said output terminal of said first gate circuit and said second input terminal being coupled to said output terminal of said second circuit to provide a pulse at said output terminal of said second gate only when a pulse from said first gate is applied to only said first input terminal; of said second gate and circuit coupled to said output terminal of said second gate circuit and responsive to signals therefrom to develop an alarm indicating an out-of-bounds shot.

14. The system as defined in claim 13 wherein said establishing means comprises a dual beam laser projector and a plurality of reflectors positionable near corners of a tennis court to direct inner and outer beams of light along the boundary of a tennis court.

15. The system as defined in claim 14 wherein said first and second detectors each comprise a photomultiplier.

16. The system as defined in claim 13 wherein said first and second circuits each comprise a monostable multivibrator.

17. The system as defined in claim 16 wherein said first and second gate circuits each comprise a NAND gate.

18. The system as defined in claim 17 wherein said alarm circuit means includes an indicator light for providing a visual indication when an out-of-bounds shot occurs.

* * * * *